US009797176B2

(12) United States Patent
Balbo Di Vinadio

(10) Patent No.: US 9,797,176 B2
(45) Date of Patent: Oct. 24, 2017

(54) DEVICE FOR OPENING AND CLOSING AN OUTWARDLY OPENING PIVOTING WING

(71) Applicant: SAVIO S.p.A., Chiusa San Michele (Turin) (IT)

(72) Inventor: Aimone Balbo Di Vinadio, Chiusa San Michele (IT)

(73) Assignee: SAVIO S.P.A., Chiusa San Michele (Turin) (IT)

( * ) Notice: Subject to any disclaimer, the term of this patent is extended or adjusted under 35 U.S.C. 154(b) by 0 days.

(21) Appl. No.: 15/127,749

(22) PCT Filed: Mar. 10, 2015

(86) PCT No.: PCT/IB2015/051724
§ 371 (c)(1),
(2) Date: Sep. 20, 2016

(87) PCT Pub. No.: WO2015/140667
PCT Pub. Date: Sep. 24, 2015

(65) Prior Publication Data

US 2017/0152695 A1 Jun. 1, 2017

(30) Foreign Application Priority Data

Mar. 20, 2014 (IT) ..... TO2014A0230

(51) Int. Cl.
*E05F 11/14* (2006.01)
*E06B 3/36* (2006.01)
(Continued)

(52) U.S. Cl.
CPC ..... *E05F 11/14* (2013.01); *E05C 9/063* (2013.01); *E05F 11/145* (2013.01); *E05F 11/16* (2013.01);
(Continued)

(58) Field of Classification Search
CPC . E05F 11/10; E05F 11/14; E05F 11/16; E05F 11/24; E05C 9/24; E05C 9/063;
(Continued)

(56) References Cited

U.S. PATENT DOCUMENTS 2,114,645 A 4/1938 Benschoten
4,679,352 A * 7/1987 Bates ..... E05D 15/30 49/192

(Continued)

OTHER PUBLICATIONS

International Search Report and Written Opinion dated May 19, 2015 for Application No. PCT/IB2015/051724.

*Primary Examiner* — Justin Rephann
(74) *Attorney, Agent, or Firm* — Patterson & Sheridan, LLP

(57) ABSTRACT

A device for opening and closing an outwardly opening pivoting wing, comprising: an actuating device including a support, a crank rotatable relative to the support and a control mechanism operated by the crank, and an arm having a toothed portion which cooperates with said control mechanism, wherein the control mechanism cooperates with the toothed portion of the arm for the translational motion of the arm along a rectilinear direction between a locked wing position and an unlocked wing position, and vice versa, a first and a second slider intended to engage a groove of the wing in a movable manner in a rectilinear direction, wherein the first slider is articulated at a distal end of the arm and wherein the second slider is connected to a locking device.

9 Claims, 12 Drawing Sheets

(51) Int. Cl.
*E05C 9/06* (2006.01)
*E05F 11/34* (2006.01)
*E05F 11/16* (2006.01)

(52) U.S. Cl.
CPC ..... *E05F 11/34* (2013.01); *E05Y 2900/148* (2013.01)

(58) Field of Classification Search
CPC ..... E05C 9/185; E05C 9/1808; E05C 9/16; E05C 9/1833; E05Y 2900/148
See application file for complete search history.

(56) References Cited

U.S. PATENT DOCUMENTS 5,636,476 A * 6/1997 Eikmeier ..... E05F 11/16 49/246
6,122,863 A * 9/2000 Tippin ..... E05F 11/16 49/279
6,135,511 A * 10/2000 Smith ..... E05C 9/063 292/139
7,013,604 B1 * 3/2006 Moody ..... E05C 9/10 49/341
7,396,054 B2 * 7/2008 Carrier ..... E05B 17/0025 292/302
9,518,416 B2 * 12/2016 Pacini ..... E05F 11/24
2005/0016073 A1 * 1/2005 Petta ..... E05C 9/02 49/504
2010/0101148 A1 * 4/2010 Carrier ..... E05F 11/16 49/346
2011/0078956 A1 * 4/2011 Lambertini ..... E05C 9/24 49/221
2012/0174487 A1 * 7/2012 Lambertini ..... E05F 11/16 49/353
2013/0025207 A1 * 1/2013 Lambertini ..... E05C 9/063 49/300
2015/0013230 A1 * 1/2015 Balbo Di Vinadio .. E05D 15/44 49/359
2016/0130847 A1 * 5/2016 Gramstad ..... E05C 9/1833 49/394

* cited by examiner

DEVICE FOR OPENING AND CLOSING AN OUTWARDLY OPENING PIVOTING WING

FIELD OF THE INVENTION

The present invention refers to accessories for doors and windows and relates to a device for opening and closing an outwardly opening pivoting wing.

The invention can be applied to wings articulated about vertical axes or to wings articulated about horizontal axes.

DESCRIPTION OF THE PRIOR ART

Devices for opening and closing an outwardly opening pivoting wing are known, comprising:

- an actuating device including a crank associated with a worm screw and a rotatable gear wheel driven in rotation by said worm screw, and
- an arm, pivoting about a fixed pin and having a toothed portion which meshes with said gear wheel, wherein said gear wheel cooperates with the toothed portion for swinging the arm between a closed wing angular position and an open wing angular position.

The openable wings are normally equipped with a locking device to lock the wing in the closed position. In the known solutions, the locking/unlocking device of the wing is separate and independent from the opening/closing device of the wing. The locking device can, for example, be controlled by a cremone handle or by any other known type of device. Therefore, two independent operations are required to control the locking/unlocking of the wing and the opening/closing movement.

U.S. Pat. No. 2,114,645 describes a device for opening and closing a pivoting wing equipped with a crank actuating device that also controls the locking and unlocking of the wing. The device described in U.S. Pat. No. 2,114,645 comprises:

- an actuating device including a support, a crank rotatable relative to the support and a control mechanism actuated by the crank, and
- an arm having a toothed portion which cooperates with said control mechanism, wherein the control mechanism cooperates with the toothed portion for swinging the arm between a closed wing angular position and an open wing angular position, and wherein in the closed wing angular position, the control mechanism cooperates with the toothed portion of the arm for the translational motion of the arm along a rectilinear direction between a locked wing position and an unlocked wing position, and vice versa.

One of the drawbacks of the solution described in U.S. Pat. No. 2,114,645 is that the connection between the arm and the locking/unlocking device of the wing is insufficiently effective.

OBJECT AND SUMMARY OF THE INVENTION

The present invention aims to provide a device for opening and closing a pivoting wing which also controls the locking and unlocking of the wing wherein the connection between the arm and the locking/unlocking device of the wing is more effective and functional.

According to the present invention, this object is achieved by a device having the characteristics forming the subject of claim 1.

The claims form an integral part of the disclosure provided in relation to the invention.

BRIEF DESCRIPTION OF THE DRAWINGS

The present invention will now be described in detail with reference to the attached drawings, given purely by way of non-limiting example, in which.

DETAILED DESCRIPTION

Figure 1:
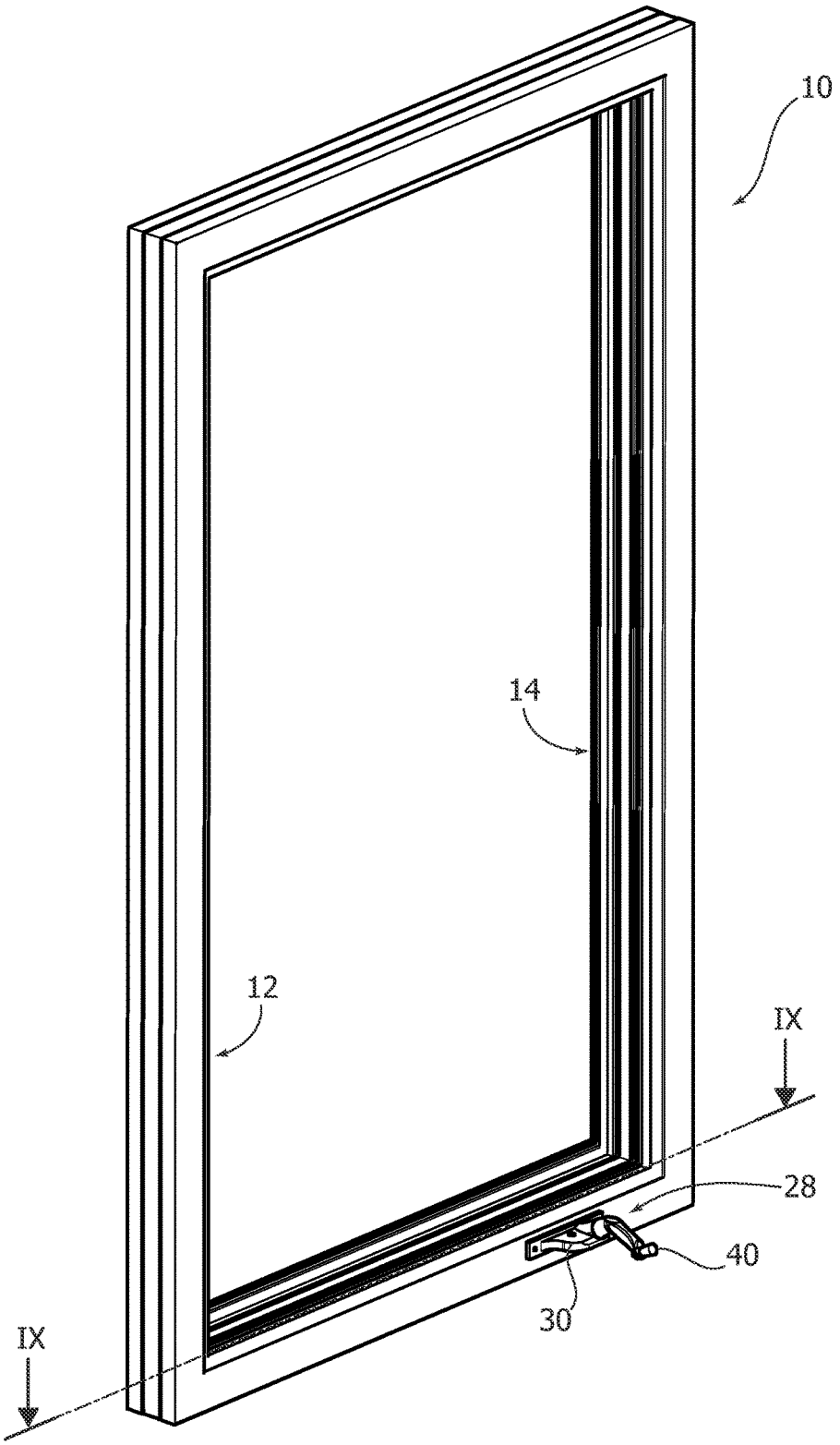
FIGS. 1 and 2 are perspective views of a wing equipped with an opening and closing device according to the present invention, in the closed position and in the open position, respectively.
Figure 2:
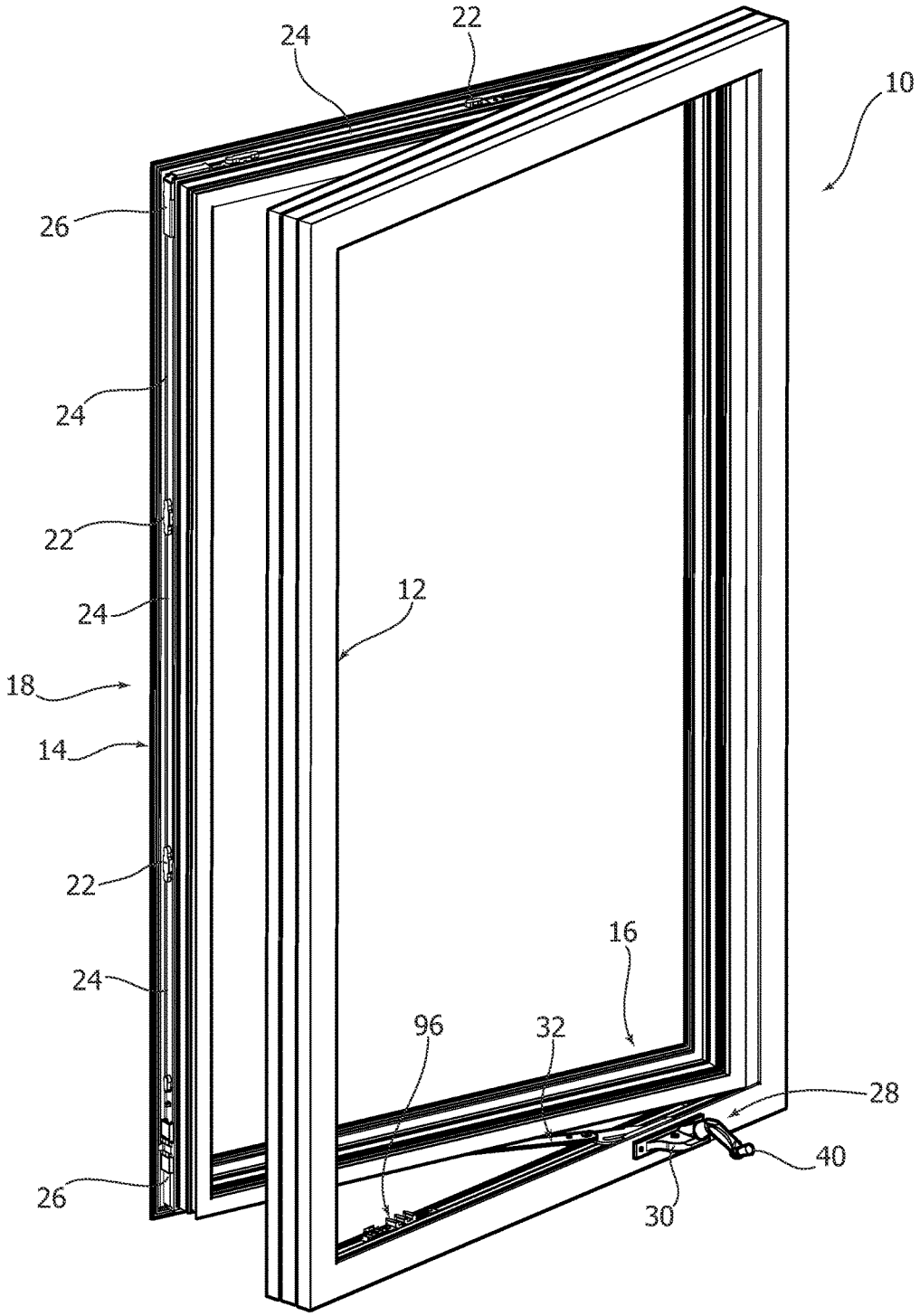

With reference to FIGS. 1 and 2, numeral 10 indicates a window including a fixed frame 12 and an outwardly openable wing 14 articulated to the fixed frame 12 about a vertical axis.

Figure 3:
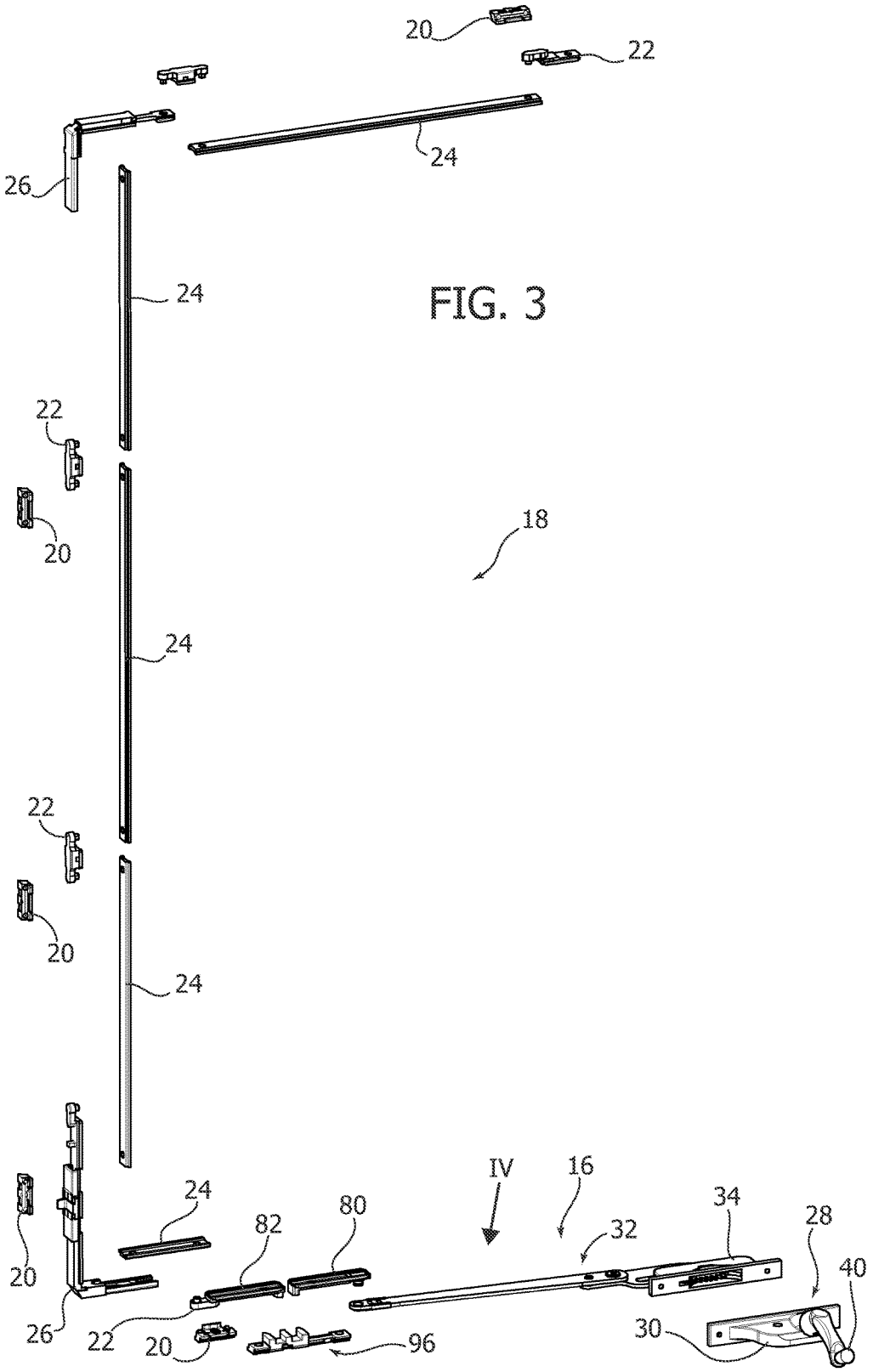
FIG. 3 is an exploded perspective view illustrating an opening/closing device according to the present invention together with a locking device.

With reference to FIG. 3, numeral 16 indicates a device for opening and closing the pivoting wing 14. The device 16 is intended to be mounted on the fixed frame 12, for example on the lower horizontal side of the frame 12. The wing 14 is provided with a locking device 18 to lock the wing 14 in a closed position. The locking device 18 is of a type known per se and comprises a plurality of strikers 20 fixed to the frame along the lower horizontal side, the upper horizontal side and along the vertical side opposite the articulation axis. The locking device 18 comprises a plurality of locking elements 22 cooperating with respective strikers 20. The locking elements are carried by the wing 14 and are located on the lower horizontal side, on the upper horizontal side and on the vertical side of the wing 14 opposite to the articulation axis. The locking elements 22 are movable relative to the wing 14 between an unlocked position and a locked position. The locking elements 22 are connected together by means of connecting rods 24 and by means of corner drive assemblies 26, in a manner known per se.

Figures 4, 8:
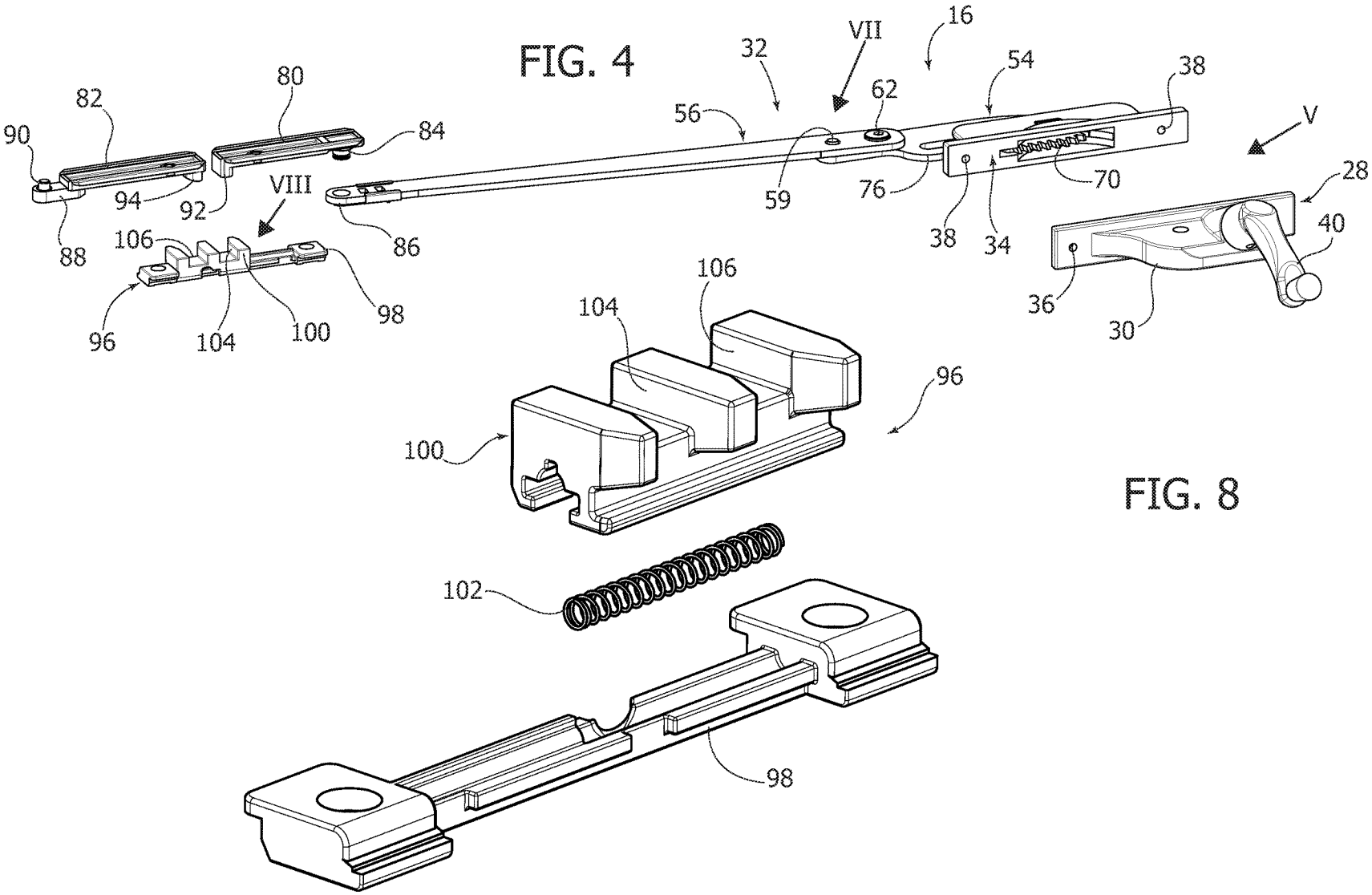
FIG. 4 is a perspective view on an enlarged scale of the opening/closing device according to the invention indicated by the arrow IV in FIG. 3.
FIG. 8 is an exploded perspective view of the component indicated by the arrow VIII in FIG. 4.

With reference to FIG. 4, the opening and closing device 16 comprises a crank actuating device 28 including a first support 30 intended to be fixed to the fixed frame 12. The first support 30 carries a rotatable crank 40. The device 16 comprises an arm 32 carried in a pivoting manner by a second support 34 intended to be fixed to the fixed frame 12 in a position facing the first support 30. The first and the second supports 30, 34 are intended to be fixed on opposite faces of a same wall of the fixed frame 12. The first and the second supports 30, 34 are provided with holes 36, 38 aligned with each other and designed to be engaged by fastening screws (not shown).

Figure 6:
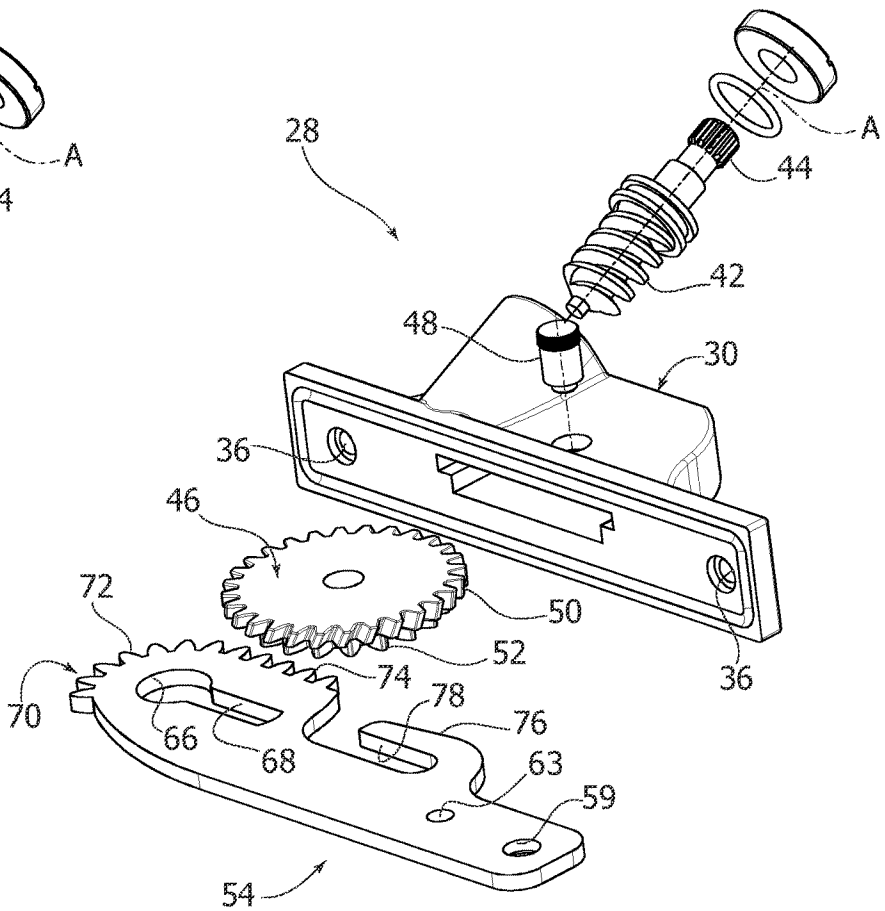
Figure 5:
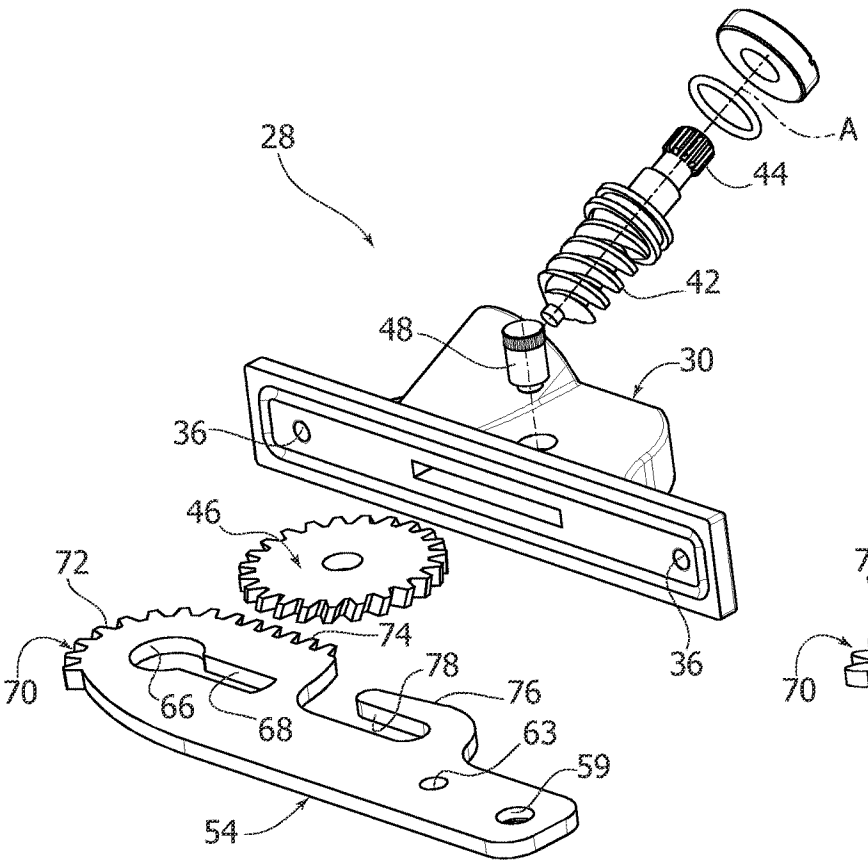
FIG. 5 is an exploded perspective view of some components indicated by the arrow V in FIG. 4, FIGS. 6 and 6A are perspective views illustrating two variants of FIG. 5.
Figure 6A:
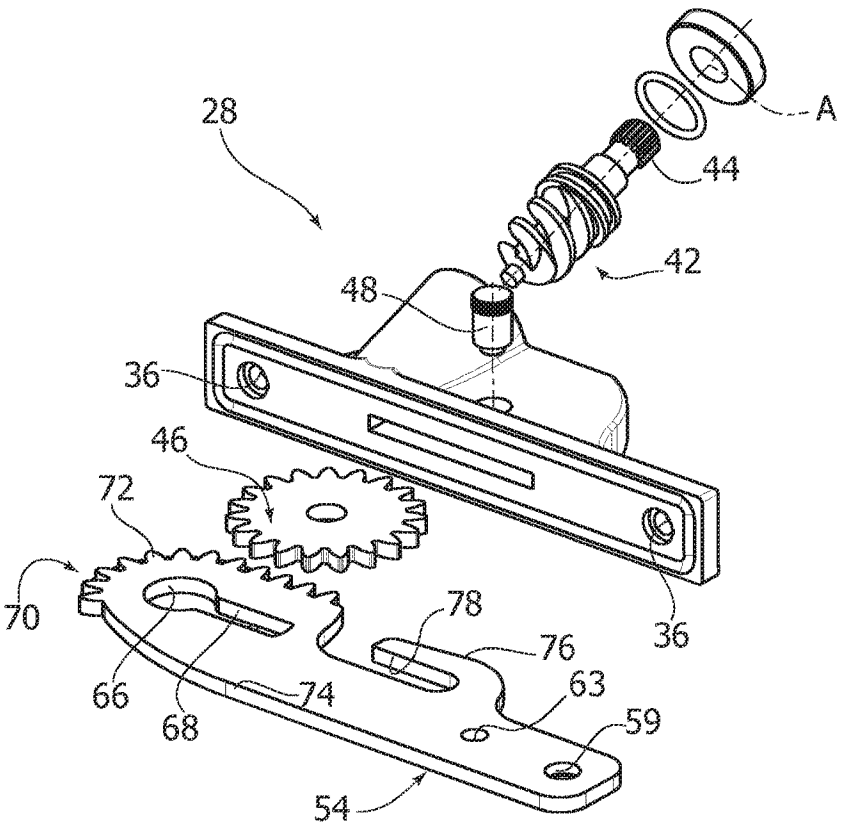

With reference to FIGS. 5, 6 and 6A, the actuating device 28 comprises a worm screw 42 rotatable relative to the first support 30 about an axis A coinciding with the axis of rotation of the crank 40. The crank 40 is fixed to an end 44 of the worm screw 42. The actuating device 28 comprises a gear wheel 46 rotatably mounted relative to the first support 30 about a fixed pin 48. In the embodiment illustrated in FIG. 5, the gear wheel 46 has a toothing with helical teeth which meshes with the worm screw 42. In the variant illustrated in FIG. 6, the gear wheel 46 has a first toothing 50 with helical teeth and a second toothing 52 with straight teeth. The two toothings 50, are fixed and coaxial with each other. The first toothing 50 meshes with the worm screw 42. In the variant illustrated in FIG. 6A, the gear wheel 46 has a toothing with straight teeth which meshes with the worm screw 42.

Figure 7:
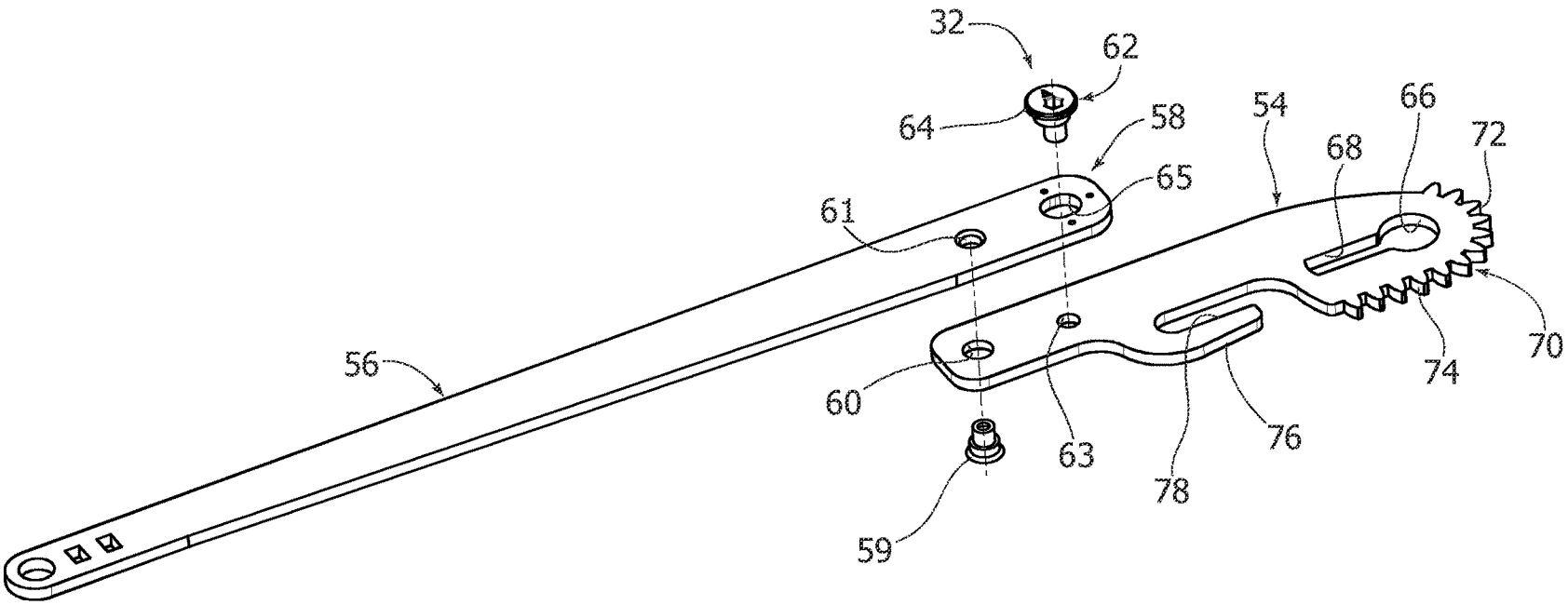
FIG. 7 is an exploded perspective view of the arm indicated by the arrow VII in FIG. 4.

With reference to FIG. 7, the arm 32 comprises a first arm section 54 and a second arm section 56 fixed together by means of an adjusting device 58, which allows adjustment of the angular position of the second arm portion 56 relative to the first arm portion 54. The adjusting device 58 comprises a first pin 59 which engages two aligned holes 60, 61 and connects together the first and the second arm portions 54, 56 in an articulated manner. The adjusting device 58 further comprises a second pin 62 which rotatably engages a hole 63 of the first arm section 54. The second pin 62 has an eccentric portion 64 which engages a slot 65 of the second arm section 56. An angular movement of the second pin 62 about its axis varies the angular position of the second arm section 56 relative to the first arm section 54. Following the adjustment, the two arm sections 54, 56 are fixed to each other in the selected position.

The first arm section 54 has an articulation seat 66 with a circular profile which communicates with a straight guide 68 radial with respect to the center of the articulation seat 66. The straight guide 68 and the articulation seat 66 may be formed by a through opening. The articulation seat 66 has a circular profile interrupted at the straight guide 68. The straight guide 68 has two parallel straight walls that define a straight opening that leads to the articulation seat 66.

The first arm section 54 has a toothed portion 70 composed of a circular toothed portion 72 and of a straight toothed portion 74. The teeth of the toothed portion 70 extend in a continuous manner and with a constant pitch along the circular toothed portion 72 and along the straight toothed portion 74. In the illustrated embodiment, the circular toothed portion 72 is coaxial with the articulation seat 66 and the straight toothed portion 74 is parallel to the straight guide 68. In other embodiments, the straight guide 68 may not be parallel to the straight toothed portion 74 and the circular toothed portion 72 may not be coaxial to the articulation seat 66. The toothed portion 70 may be formed in one piece with the first arm section 54 or may be formed by a separate component fixed to the first arm section 54.

With reference to FIG. 5, the toothed portion 70 of the first arm section 54 can have teeth with helical sides which mesh directly with the helical toothing of the gear wheel 46. Alternatively, as shown in FIGS. 6 and 6A, the toothing 70 of the first arm section 54 can have teeth with straight sides which mesh with the toothing with straight sides of the gear wheel 46. The first arm section 54 can also be provided with a hook portion 76 with a wall 78 parallel to the straight guide 68. The wall 78 need not necessarily be parallel to the straight guide 68.

With reference to FIG. 4, the device 16 comprises a first slider 80 and a second slider 82, intended to be slidably mounted within a longitudinal groove of the lower horizontal side of the wing 14. The first slider 80 has a pin 84 which rotatably engages a hole 86 arranged at the distal end of the arm 32. The second slider 82 has an integral closing element 88 which is intended to be connected to a connecting rod 24 of the locking device 18 by means of a pin 90. The sliders 80, 82 are provided with respective projecting teeth 92, 94.

With reference to FIGS. 4 and 8, the device 16 comprises a connecting member 96 including a base 98 intended to be fixed to the frame 12 and a striker 100 movable on the base 98 in a rectilinear direction. A helical spring 102 is arranged between the movable striker 100 and the base 98 and tends to push the movable striker 100 toward a predetermined position. The movable striker 100 has two seats 104, 106 which are intended to be engaged by the respective teeth 92, 94 of the sliders 80, 82.

Figure 10:
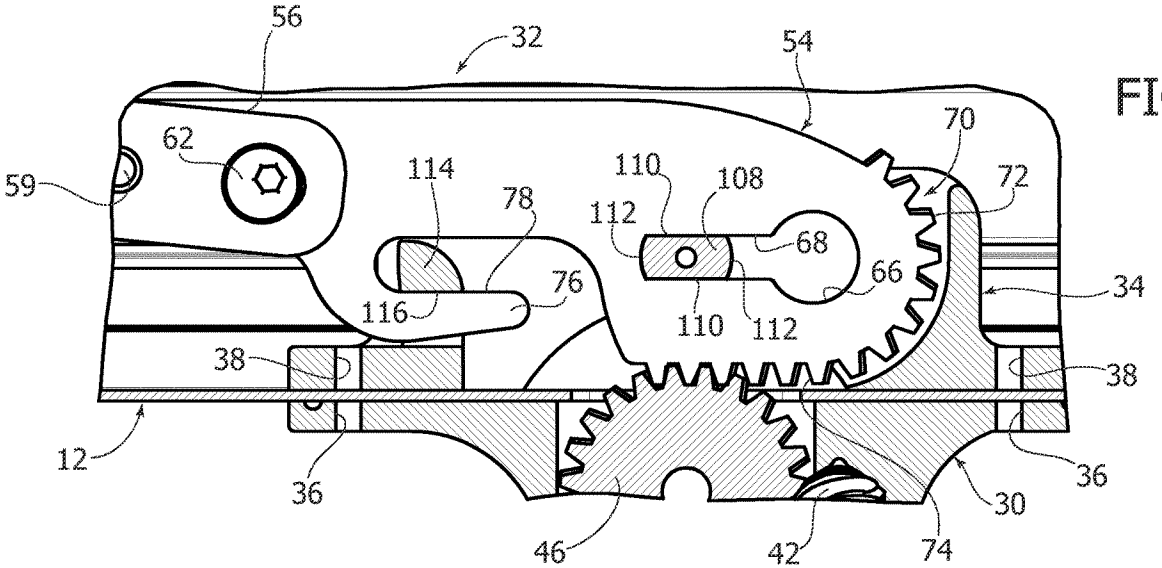

With reference to FIG. 10, the articulation portion 66 and the guide portion 68 of the first arm section 54 cooperate with a pin 108 fixed relative to the second support 34. The pin 108 has two parallel walls 110 spaced apart by a distance equal to the width of the straight guide 68 and two arcuate walls 112 with a radius of curvature equal to the radius of the articulation seat 66. The first support 30 also has a fixed appendix 114 provided with an opening 116 intended to be engaged by the hook portion 76 of the first arm section 54.

The arm 32 is movable between a closed wing angular position and an open wing angular position, and vice versa. In the closed wing angular position, the arm 32 is movable in a rectilinear direction between a locked wing position and an unlocked wing position, and vice versa. Both the angular movement of the arm 32, and the movement in the rectilinear direction, are controlled by rotation of the crank 40.

Figure 9:
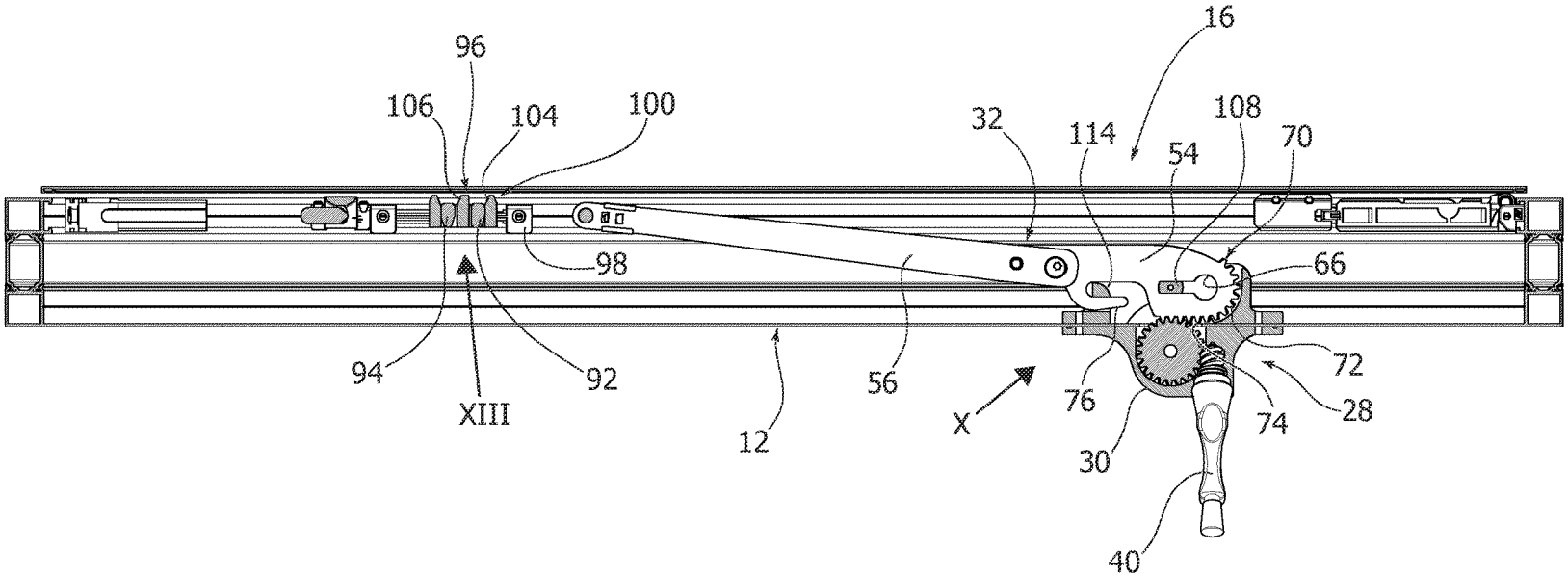
FIG. 9 is a cross-section according to the line IX-IX of FIG. 1, FIGS. 10, 11 and 12 are enlarged details of the part indicated by the arrow X in FIG. 9, in the locked wing position, unlocked wing position and open wing position, respectively.
Figure 13:
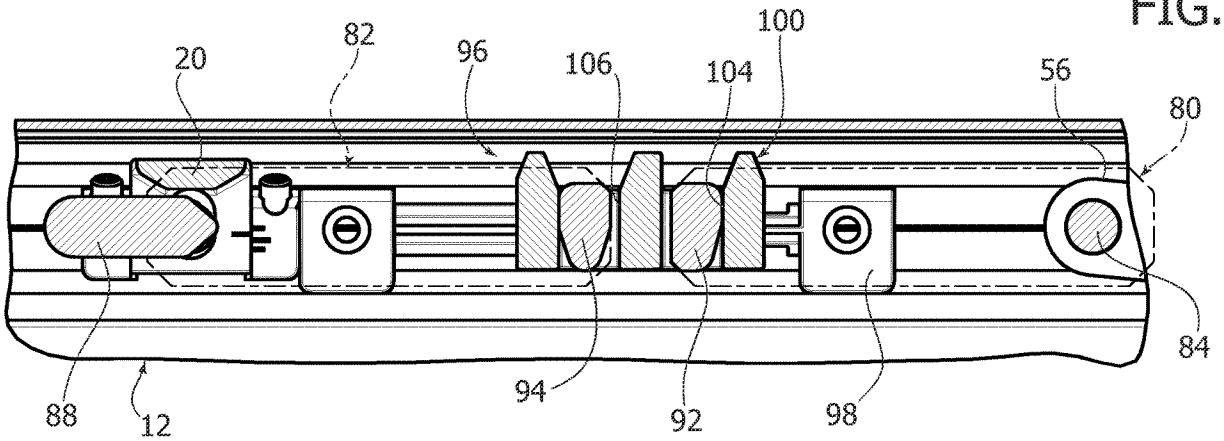
FIGS. 13, 14 and 15 are enlarged details of the part indicated by the arrow XIII in FIG. 9, in the locked wing position, unlocked wing position and open wing position, respectively.

FIGS. 9, 10 and 13 show the opening/closing device 16 in the closed and locked wing position. In this position, the gear wheel 46 meshes with the straight portion 74 of the toothing 70. The pin 108 engages the straight guide 68. One of the arcuate walls 112 of the pin 108 is in abutment against the end of the straight guide 68 opposite to the articulation seat 66. The hook portion 76 engages the opening 116 of the projection 114. The teeth 92, 94 of the sliders 80, 82 engage the respective seats 104, 106 of the movable striker 100 of the connecting device 96. The closing element 88 of the slider 82 engages a respective fixed striker 20. All the closing elements 22 of the locking device 18 engage the respective fixed strikers 20. In this condition, the wing 14 is locked relative to the frame 12 along the lower horizontal side, the upper horizontal side and along the vertical side opposite to the articulation axis of the wing 14.

Starting from this condition, the control device 28 allows unlocking and opening of the wing 14 solely by the rotating movement of the handle 40. Rotating of the handle 40 drives the gear wheel 46 in rotation by means of the worm screw 42.

Figure 14:
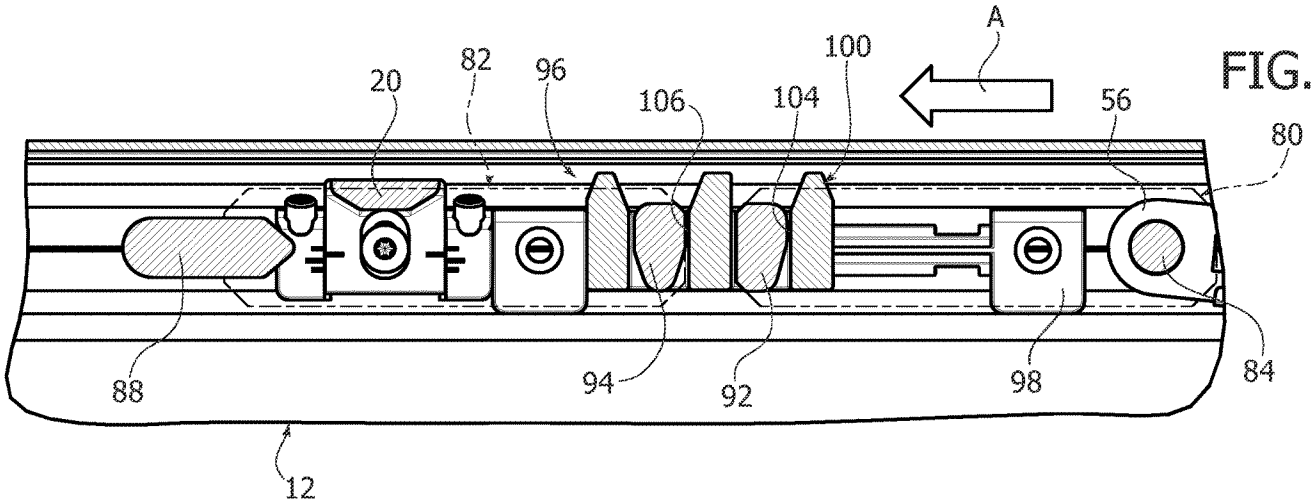
Figure 11:
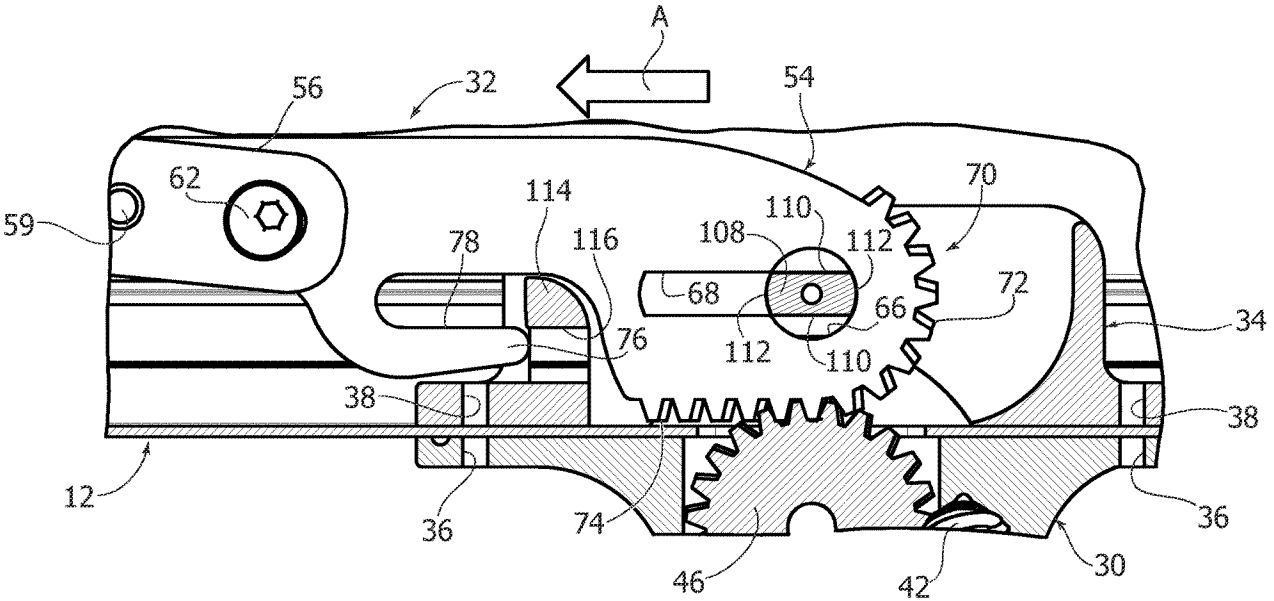

With reference to FIGS. 11 and 14, in a first step, the gear wheel 46 controls the movement in the rectilinear direction of the arm 32 in the direction indicated by the arrow A as a result of the meshing of the gear wheel 46 with the straight portion 74 of the toothing 70. Following this movement, as shown in FIGS. 11 and 14, the pin 108 disengages from the straight guide 68 and engages the articulation seat 66. One arcuate wall 112 of the pin 108 comes into contact with the circular wall of the articulation seat 66 in a position opposite to the straight guide 68. In this position, the pin 108 is completely disengaged from the straight guide 68 and only engages the circular articulation seat 66. In this condition, the gear wheel 46 meshes with the end of the straight toothed portion adjacent to the circular toothed portion 72. The hook portion 76 disengages from the opening 116 of the projection 114. The first slider 80 moves the movable striker 100 in the rectilinear direction relative to the base 98. The movable striker 100 in turn moves the second slider 82. The closing element 88 of the slider 82 disengages from the respective fixed striker 20. All the closing elements 22 of the locking device 18 disengage from the respective fixed strikers 20. In this condition, the wing 14 is still in the closed position but is unlocked.

Figure 12:
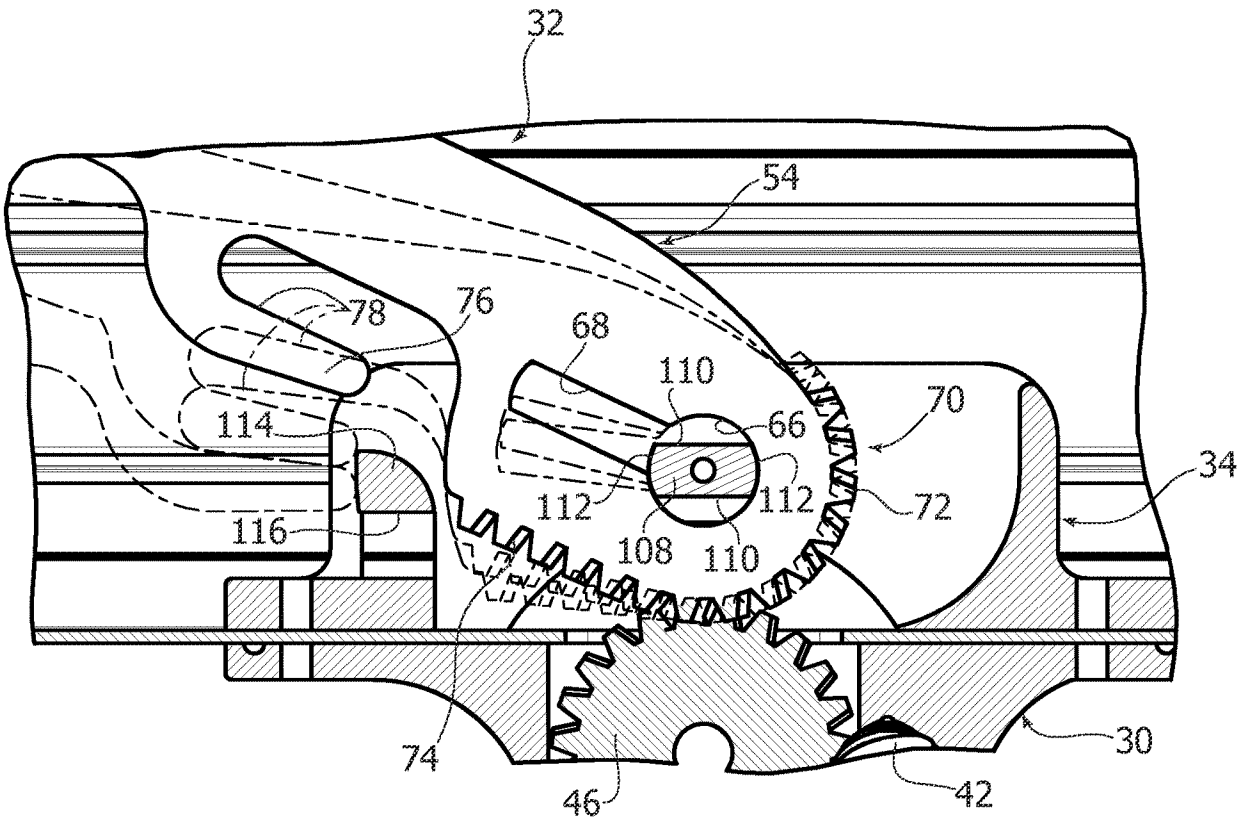
Figure 15:
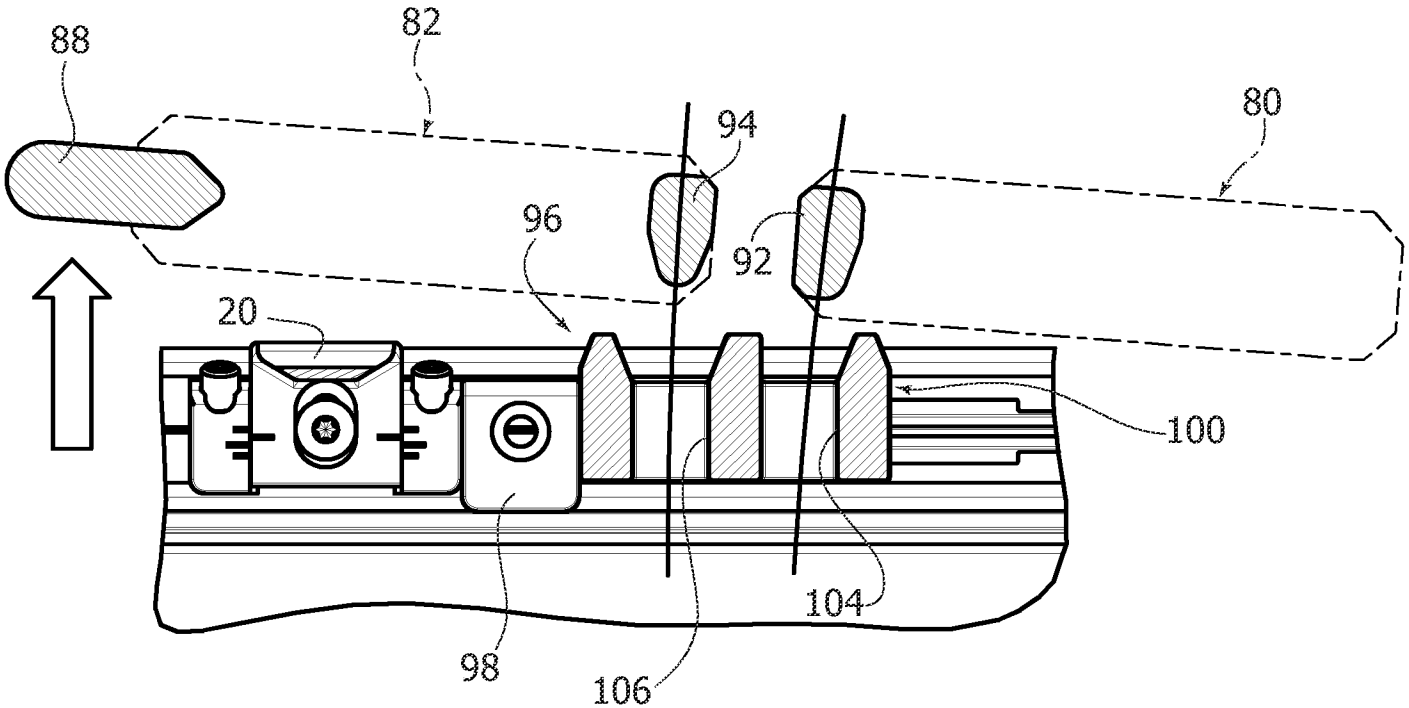

Continuing to rotate the crank 40 in the same direction, the gear wheel 46 meshes with the circular toothed portion 72 of the toothing 70 and drives in rotation the arm 32 about the pin 108, as illustrated in FIG. 12. With reference to FIG. 15, the teeth 92, 94 of the sliders 80, 82 are disengaged from the respective seats 104, 106 of the movable striker 100. The movable striker 100 is maintained in the position of FIG. 15 by the spring 102 (FIG. 8). The pivoting of the arm 32 about the pin 108 opens the wing 14. During the opening movement of the wing 14, the slider moves in the rectilinear direction into the respective groove of the wing 14 while the slider 82 remains stationary.

Closing of the wing 14 is controlled by operating the crank 40 in the opposite direction. The closing and locking operations of the wing take place according to a sequence opposite to that previously described. The teeth 92, 94 of the sliders 80, 82 engage the seats 104, 106 of the movable striker 100 when the arm 32 reaches the closed wing angular position. At this point, the arm 32 moves in a rectilinear direction thanks to the engagement of the gear wheel 46 with the straight toothed portion 74 of the toothing 70. The movement in the rectilinear direction of the arm 32 from the unlocked wing position to the locked wing position consequently moves the movable striker 100 of the connecting device 98. The movable striker 100 moves the slider 82, which controls the movement of the locking device 18 from the unlocked position to the locked position.

From the preceding description it is clear that the device according to the present invention does not require a separate control device to unlock the wing 14 prior to controlling the opening, or to lock the wing after the closing operation. The unlocking and locking operations take place automatically by rotating the crank 40 itself, which controls the opening and closing movement of the wing 14.

Of course, without prejudice to the principle of the invention, the details of construction and the embodiments may be widely varied with respect to what is described and illustrated without departing from the scope of the invention as defined by the following claims.

The invention claimed is:

1. A device for opening and closing an outwardly opening pivoting wing, comprising:

an actuating device including a support, a crank rotatable relative to the support and a control mechanism operated by the crank, and an arm having a toothed portion which cooperates with said control mechanism, wherein the control mechanism cooperates with the toothed portion for swinging the arm between a closed wing angular position and an open wing angular position, and wherein in the closed wing angular position, the control mechanism cooperates with the toothed portion of the arm for the translational motion of the arm along a rectilinear direction between a locked wing position and an unlocked wing position, and vice versa, characterized in that it comprises:

a first and a second slider for engagement with a groove of the wing in a movable manner in the rectilinear direction, wherein the first slider is articulated at a distal end of the arm and wherein the second slider is connected to a locking device including a plurality of locking elements carried by the wing and connected to each other by a plurality of connecting rods, and a connecting member intended to be mounted on a fixed frame of the wing, said connecting member comprising a fixed base and a striker movable in the rectilinear direction, wherein the movable striker comprises two seats for engagement by respective teeth of the first and second sliders.

2. A device according to claim 1, characterized in that said arm has a circular articulation seat communicating with a straight guide radial with respect to said circular articulation seat, wherein said fixed pin engages said straight guide in the locked wing position and engages said circular articulation seat in said unlocked wing position.

3. A device according to claim 1, characterized in that said arm comprises a hook portion which in said locked wing position engages an opening of a fixed projection.

4. A device according to claim 1, characterized in that said control mechanism comprises a worm screw fixed to said crank and meshing with a gear wheel.

5. A device according to claim 4, characterized in that said gear wheel has a toothing with helical teeth and in that said toothed portion of the arm has a toothing with helical teeth which meshes with said toothing with helical teeth of the gear wheel.

6. A device according to claim 4, characterized in that said gear wheel has a first toothing with helical teeth and a second toothing with straight teeth, wherein the first toothing meshes with said worm screw and wherein said toothed portion of the arm has a toothing with straight teeth, which meshes with said second toothing.

7. A device according to claim 4, characterized in that said gear wheel has a toothing with straight teeth, and in that said toothed portion of the arm has a toothing with straight teeth which meshes with said toothing with straight teeth of the gear wheel.

8. A device according to claim 1, characterized in that said toothed portion of the arm has a circular toothed portion and a straight toothed portion adjacent to each other.

9. A device according to claim 1, characterized in that said arm comprises a first arm portion and a second arm portion fixed together by means of an adjusting device which allows adjustment of the angular position between the first and the second arm portions.

* * * * *